US007533663B2

(12) United States Patent
Gan

(10) Patent No.: US 7,533,663 B2
(45) Date of Patent: May 19, 2009

(54) PNEUMATIC PAINTBALL GUN

(76) Inventor: Yiauguo Gan, No. 388-1, Houjuang Road, Beitun Chu, Taichung (TW) 40682

( * ) Notice: Subject to any disclaimer, the term of this patent is extended or adjusted under 35 U.S.C. 154(b) by 473 days.

(21) Appl. No.: 11/510,098

(22) Filed: Aug. 25, 2006

(65) Prior Publication Data

US 2008/0047538 A1 Feb. 28, 2008

(51) Int. Cl.
*F41B 11/00* (2006.01)

(52) U.S. Cl. ..... 124/70; 124/73; 124/74; 124/76

(58) Field of Classification Search ..... 124/70, 124/71, 73, 74, 75, 76, 77
See application file for complete search history.

(56) References Cited

U.S. PATENT DOCUMENTS 5,613,483 A * 3/1997 Lukas et al. ..... 124/73
6,360,736 B1 3/2002 Juan ..... 124/77
2006/0243264 A1* 11/2006 Gardner et al. ..... 124/74
2006/0278206 A1* 12/2006 Dobbins et al. ..... 124/74
2007/0163562 A1* 7/2007 Gan ..... 124/73
2007/0186916 A1* 8/2007 Jones ..... 124/74

* cited by examiner

*Primary Examiner*—J. Woodrow Eldred
(74) *Attorney, Agent, or Firm*—Banger Shia

(57) ABSTRACT

A gun device includes a housing having a gas supplying passage communicating with a gas storage chamber of the housing for coupling to a pressurized gas supplying source, a feed tube for feeding a bullet into the housing. The pressurized gas supplied into the gas storage chamber of the housing may all be used to fire the bullet. In addition, the pressurized gas supplied into a manifold of the housing may be used to move a cylinder and a piston and may also be recycled and used to fire the bullet such that the bullet may be fired or propelled with a greater quantity of the pressurized gas and thus may be fired or propelled for a longer distance, for economizing the pressurized gas.

12 Claims, 3 Drawing Sheets

PNEUMATIC PAINTBALL GUN

BACKGROUND OF THE INVENTION

1. Field of the Invention

The present invention relates to a pneumatic paintball gun, and more particularly to a pneumatic paintball gun including a structure or mechanism for collecting or reusing the pressurized air or gas that has been used for firing the paintball or bullet and thus for effectively using or employing the pressurized air or gas and for economizing the pressurized air or gas.

2. Description of the Prior Art

Typical pneumatic paintball guns or bullet guns comprise a handgun shaped gun body including a hand grip for being held or grasped by the users, and including a loading assembly disposed in the upper portion of the gun body for feeding the paintballs or bullets into the firing chamber of the gun body one by one, and including a firing assembly disposed in the middle or lower portion of the gun body for firing the paintballs or bullets out of the firing chamber of the gun body, and including a high pressure gas container coupled to the firing assembly for selectively supplying the high pressure gas to fire the paintballs or bullets, and including a valve device for controlling or actuating the firing assembly to fire the paintballs or bullets.

For example, U.S. Pat. No. 6,360,736 to Juan discloses one of the typical air gun firing systems comprising an upper chamber formed in the upper portion of the gun body for receiving a loading assembly which may be used for feeding the paintballs or bullets into the firing chamber of the gun body one by one, and a middle or lower chamber formed in the middle or lower portion of the gun body for receiving a firing assembly which may be used for selectively firing the paintballs or bullets out of the firing chamber of the gun body.

However, normally, the high pressure gas may only be supplied into the firing chamber of the gun body to fire or to propel the paintballs or bullets out of the firing chamber of the gun body and will be discharged after the firing operation, such that a portion of the high pressure gas that is initially supplied into the firing chamber of the gun body will be separated and guided to recover the firing device and/or the loading device and/or the valve device of the typical air gun firing system and such that the high pressure gas may not be completely used to effectively fire or propel the paintballs or bullets and such that the firing or moving distance of the paintballs or bullets will be decreased.

The present invention has arisen to mitigate and/or obviate the afore-described disadvantages of the conventional pneumatic paintball guns or lacquer bullet guns.

SUMMARY OF THE INVENTION

The primary objective of the present invention is to provide a pneumatic paintball gun including a structure or mechanism for collecting or reusing the pressurized air or gas that has been used for firing the paintball or bullet and thus for effectively using or employing the pressurized air or gas and for economizing the pressurized air or gas.

The other objective of the present invention is to provide a pneumatic paintball gun including a structure or mechanism for allowing the pressurized air or gas to be completely used for firing the paintball or bullet and thus for allowing the paintball or bullet to be shot for a longer distance.

In accordance with one aspect of the invention, there is provided a gun device comprising a housing including an inner chamber formed a middle portion of the housing, and including a firing chamber formed in a front portion of the housing, and including a gas storage chamber formed in a rear portion of the housing, and including a handle for being held by a user, and including a trigger for being actuated by the user, and including a gas supplying passage formed in the housing and communicating with the gas storage chamber of the housing for coupling to a pressurized gas supplying source and for selectively supplying a pressurized gas into the gas storage chamber of the housing, and including a manifold formed in the housing, a feed tube attached to the housing for feeding a bullet into the firing chamber of the housing, and arranged for allowing the bullet to be selectively fired with the pressurized gas supplied into the gas storage chamber of the housing, a casing disposed in the housing and located in front of the gas storage chamber of the housing for forming a peripheral channel between the housing and the casing, and including a control chamber formed in the casing, and including a gas flowing path formed in the casing and communicating the control chamber of the casing with the manifold of the housing, the peripheral channel formed between the housing and the casing being communicating with the gas storage chamber of the housing, and the casing including at least one aperture formed therein and communicating the control chamber of the casing with the peripheral channel of the housing for allowing the pressurized gas to flow into the control chamber of the casing via the aperture of the casing and then to selectively flow into the firing chamber of the housing to fire the bullet, a piston slidably received in the control chamber of the casing and movable relative to the casing for selectively engaging with the casing to block the gas flowing path of the casing, and a controlling device for controlling the pressurized gas to selectively flow into the control chamber of the casing and into the firing chamber of the housing and to fire the bullet, and to control the pressurized gas in the gas flowing path of the casing to selectively flow into the firing chamber of the housing and to fire the bullet.

The housing includes a valve chamber formed therein, an inlet communicating the valve chamber with the gas supplying passage of the housing for allowing the pressurized gas to flow from the gas supplying passage into the valve chamber of the housing, a port communicating the valve chamber with the manifold of the housing for allowing the pressurized gas to flow between the valve chamber with the manifold of the housing, an outlet communicating with the valve chamber of the housing for allowing the pressurized gas to flow between the valve chamber with the firing chamber of the housing, and a valve member slidably received in the valve chamber of the housing for selectively communicating the inlet and the port and the valve chamber of the housing with each other, and also for selectively communicating the outlet and the port and the valve chamber of the housing with each other.

The valve member includes at least one sealing ring engaged onto the valve member for sealingly engaging with the housing and for selectively communicating the inlet and the port and the valve chamber of the housing with each other, and also for selectively communicating the outlet and the port and the valve chamber of the housing with each other.

A moving device may further be provided for moving the valve member relative to the housing, and includes a core coupled to the valve member for moving the valve member relative to the housing, and includes a coil disposed in the housing and the core is slidably received in the coil. A spring biasing member may further be provided and engaged between the core and the housing for recovering the core and the valve member relative to the housing when the coil is not energized.

The casing includes a pipe secured to the casing and located in the inner chamber of the housing, and the pipe includes a bore formed therein and communicating with the control chamber of the casing and the firing chamber of the housing. The piston is movable relative to the casing for selectively engaging with the pipe in order to block the bore of the pipe and to prevent the pressurized gas from flowing into the bore of the pipe and the firing chamber of the housing.

A cylinder may further be provided and slidably received in the inner chamber of the housing and slidably engaged onto the pipe, and includes a peripheral swelling extended radially and outwardly from the cylinder for sealingly engaging with the housing and the pipe and for separating the inner chamber of the housing into a first peripheral space and a second peripheral space, the first peripheral space is communicating with the manifold of the housing, and the second peripheral space is communicating with the outlet and the valve chamber of the housing.

The pipe includes an outer peripheral recess formed therein for selectively communicating with the second peripheral space of the housing. The cylinder includes an inner peripheral opening formed therein for selectively communicating with the outer peripheral recess of the pipe.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
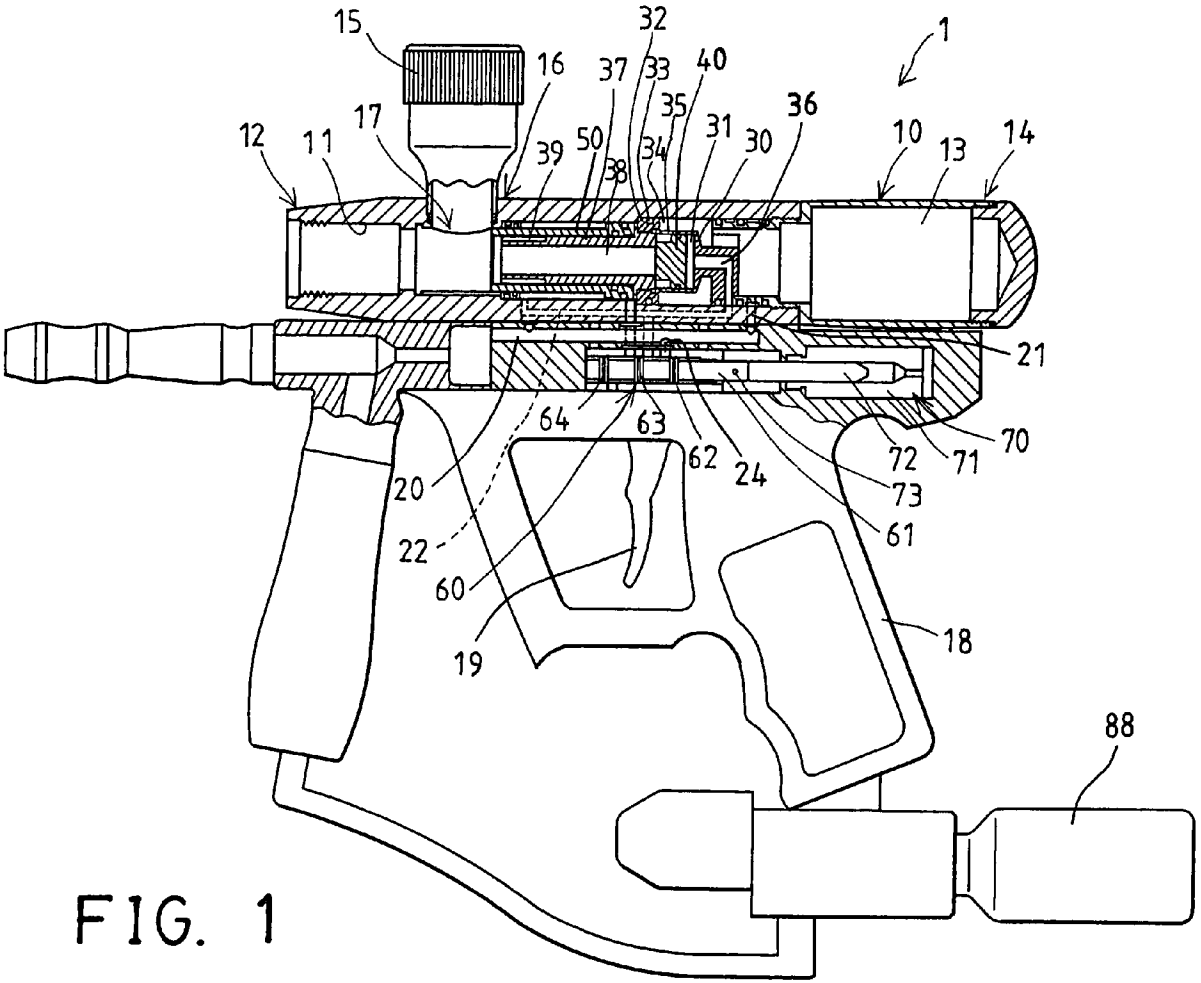
FIG. 1 is a partial cross sectional view of a pneumatic paintball gun or bullet gun device in accordance with the present invention.

Referring to the drawings, and initially to FIG. 1, a pneumatic paintball gun or bullet gun device 1 in accordance with the present invention comprises a gun body or housing 10 with a gun barrel (not shown) secured to and projected from the forward end of the housing 10. The housing 10 includes a longitudinal or inner firing chamber 11 formed therein, such as formed in the front portion of the housing 10 or of the gun barrel for receiving a paintball or a bullet 80 therein, and a gas storage chamber 13 provided or formed in the rear portion 14 of the housing 10 for receiving a pressurized air or gas therein and for selectively supplying the pressurized air or gas into the firing chamber 11 of the housing 10 in order to selectively fire the paintball or bullet 80 out of the firing chamber 11 of the housing 10.

A feed tube 15 is attached or coupled to the front or middle portion 16 of the housing 10 and includes a mouth 17 communicating with the firing chamber 11 of the housing 10 for feeding or supplying the paintball or bullet 80 into the firing chamber 11 of the housing 10 one by one. The housing 10 includes a handle 18 extended therefrom for being held or grasped by the users, and includes a pivotal trigger 19 for being pulled or actuated by the users, and includes a gas supplying passage 20 formed therein and communicating with or coupled to the gas storage chamber 13 of the housing 10 with a coupling pathway 21 and coupled to a gas supplying source 88, such as a pressure bottle 88. The coupling of the gas supplying source 88 to the housing 10 is not related to the present invention and will not be described in further details. The gas supplying source or the pressure bottle 88 may supply the pressurized air or gas through the gas supplying passage 20 and the coupling pathway 21 and then into the gas storage chamber 13 and the firing chamber 11 of the housing 10 for allowing the pressurized air or gas to be stored in the gas storage chamber 13 of the housing 10.

The housing 10 further includes a conduit or manifold 22 formed in the middle portion 16 thereof and separated from the gas storage chamber 13 of the housing 10 or not communicating with the gas storage chamber 13 of the housing 10, and further includes a valve chamber 23 formed therein, such as formed in the lower portion of the housing 10 for receiving a valve means or device 60 therein, and an inlet 24 communicating with the valve chamber 23 and the gas supplying passage 20, and a port 25 communicating with the valve chamber 23 and the manifold 22 of the housing 10, and an outlet 26 communicating with the valve chamber 23 and an inner chamber 27 or the firing chamber 11 of the housing 10, and an exit 28 for communicating the valve chamber 23 of the housing 10 with the outer environment of the pneumatic paintball gun or bullet gun device 1.

A casing 30 is disposed or secured in the housing 10 and located in front of the gas storage chamber 13 of the housing 10, and includes a control chamber 31 formed therein, and includes an outer peripheral bulge 32 extended radially and outwardly therefrom for engaging with the housing 10 and for anchoring or securing to the housing 10 with such as fasteners or latches or clamping rings or sealing rings 33, and thus for forming or defining a peripheral channel 34 between the housing 10 and the casing 30 (FIGS. 1-3), in which the peripheral channel 34 of the housing 10 is communicating with the gas storage chamber 13 of the housing 10. The casing 30 further includes one or more apertures 35 formed therein for communicating the control chamber 31 of the casing 30 with the peripheral channel 34 of the housing 10 and for allowing the pressurized air or gas to flow into the control chamber 31 of the casing 30.

Figure 2:
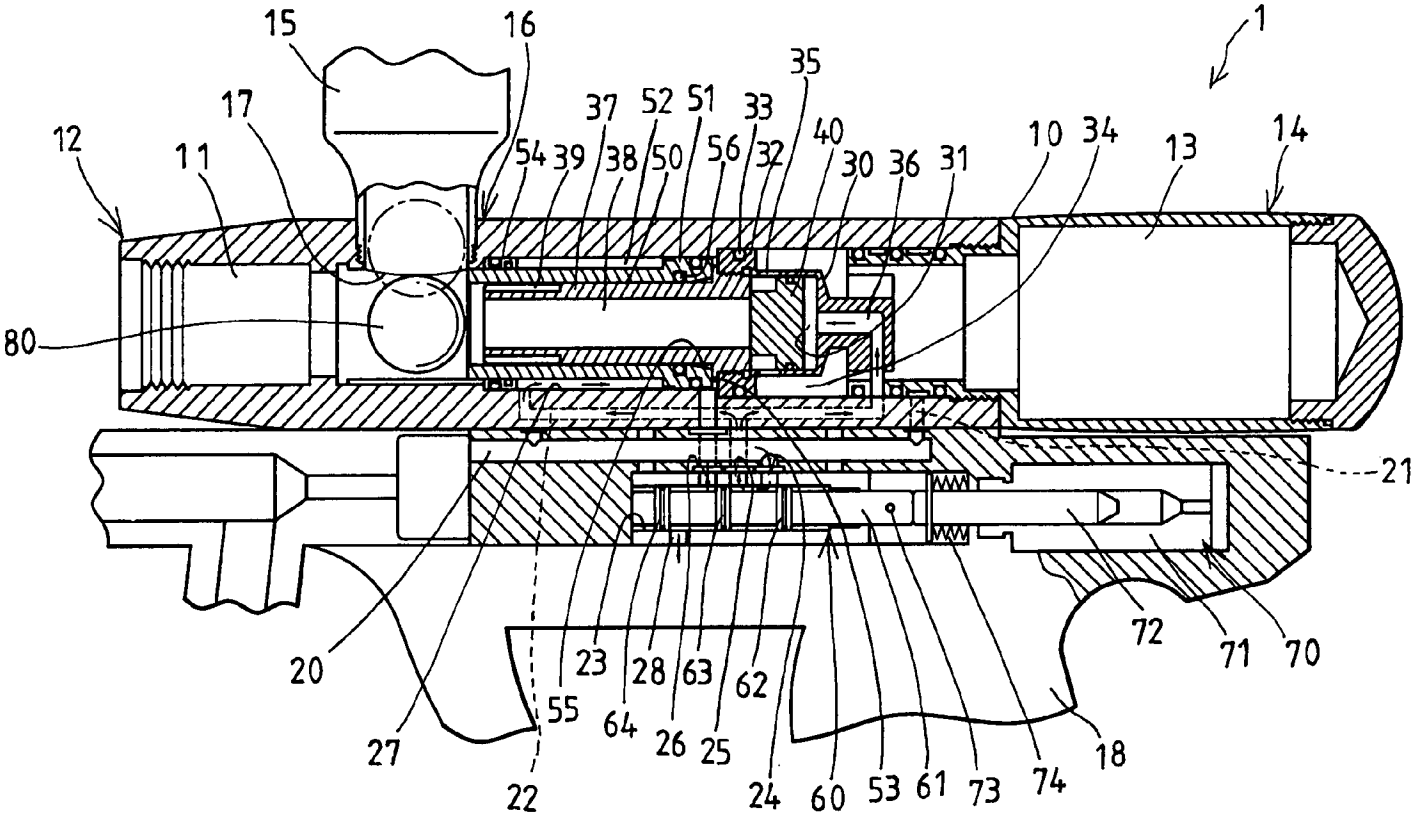
FIG. 2 is an enlarged partial cross sectional view of the pneumatic paintball gun or bullet gun device.

The casing 30 further includes a gas flowing path 36 formed therein for communicating the control chamber 31 of the casing 30 with the manifold 22 of the housing 10. As shown in FIG. 2, the pressurized air or gas supplied into the gas supplying passage 20 of the housing 10 may flow through the inlet 24 and into the valve chamber 23 of the housing 10, and may selectively flow through the port 25 and into the manifold 22 of the housing 10, and may then flow into the gas flowing path 36 and the control chamber 31 of the casing 30. The pressurized air or gas supplied into the manifold 22 of the housing 10 may also flow into the inner chamber 27 of the housing 10, or may selectively flow from the inner chamber 27 of the housing 10 into the manifold 22 of the housing 10 and then into the valve chamber 23 of the housing 10 via the port 25 of the housing 10.

A pipe 37 is secured to the casing 30 with such as a threading engagement, or formed integral with the casing 30 and disposed or located in the inner chamber 27 of the housing 10, and includes a bore 38 formed therein and communicating with the control chamber 31 of the casing 30 and also communicating with the firing chamber 11 of the housing 10 for allowing the pressurized air or gas to flow from the control chamber 31 of the casing 30 through the bore 38 of the pipe 37 and then into the firing chamber 11 of the housing 10 in order to fire or to propel the paintball or bullet 80 out of the firing chamber 11 of the housing 10. The pipe 37 further includes an outer peripheral recess 39 formed in the outer peripheral portion thereof and located distal to the casing 30 and the gas storage chamber 13 of the housing 10.

A piston 40 is slidably received or disposed in the control chamber 31 of the casing 30 and movable relative to the casing 30 and the housing 10 for selectively engaging with the casing 30 in order to block the gas flowing path 36 of the casing 30 (FIG. 3), or for selectively engaging with the pipe 37 in order to block the bore 38 of the pipe 37 (FIG. 2) and thus to prevent the pressurized air or gas from flowing into the bore 38 of the pipe 37 and the firing chamber 11 of the housing 10. As also shown in FIG. 2, the pressurized air or gas flowing from the valve chamber 23 of the housing 10 into the manifold 22 of the housing 10 may flow through the gas flowing path 36 of the casing 30 and then into the control chamber 31 of the casing 30 in order to force the piston 40 to engage with the pipe 37 and to selectively block the bore 38 of the pipe 37. The pressurized air or gas from the gas storage chamber 13 of the housing 10 and into the control chamber 31 of the casing 30 (FIG. 3) may also be used to force the piston 40 to engage with the casing 30 in order to selectively block the gas flowing path 36 of the casing 30.

A slidable cylinder 50 is slidably received or engaged in the inner chamber 27 of the housing 10 and slidably engaged onto the outer peripheral portion of the pipe 37, and includes an enlarged head or peripheral swelling 51 extended radially and outwardly therefrom for sealingly engaging with the housing 10 and also for sealingly engaging with the pipe 37, and for separating the inner chamber 27 of the housing 10 into a first peripheral space 52 and a second peripheral space 53, in which the first peripheral space 52 is located distal to the casing 30 and the gas storage chamber 13 of the housing 10 and communicating with the manifold 22 of the housing 10 for allowing the pressurized air or gas to flow between the first peripheral space 52 and the manifold 22 of the housing 10. The second peripheral space 53 is located between the peripheral swelling 51 of the cylinder 50 and the outer peripheral bulge 32 of the casing 30 and communicating with the outlet 26 and the valve chamber 23 of the housing 10 (FIG. 3).

A sealing ring or gasket 54 is received or secured or engaged in the inner chamber 27 of the housing 10 and engageable with the peripheral swelling 51 of the cylinder 50 for forming or defining the first peripheral space 52 between the peripheral swelling 51 of the cylinder 50 and the gasket 54. The cylinder 50 further includes an inner peripheral opening 55 formed therein and located in one end thereof or located within the peripheral swelling 51 for selectively communicating with the outer peripheral recess 39 of the pipe 37 (FIG. 3) and for allowing the pressurized air or gas to selectively flow from the second peripheral space 53 into the outer peripheral recess 39 of the pipe 37 and then into the firing chamber 11 of the housing 10 for further provided for firing the paintball or bullet 80 out of the firing chamber 11 of the housing 10 when the peripheral swelling 51 is moved away from the outer peripheral bulge 32 of the casing 30.

It is preferable that the cylinder 50 further includes a sealing ring 56 secured or engaged in the inner portion of the peripheral swelling 51 for sealingly engaging with the pipe 37 and for separating the inner peripheral opening 55 of the cylinder 50 from the outer peripheral recess 39 of the pipe 37 when the sealing ring 56 is sealingly engaged with the pipe 37 (FIG. 2). The second peripheral space 53 and the inner peripheral opening 55 of the cylinder 50 may selectively communicate with the outer peripheral recess 39 of the pipe 37 when the sealing ring 56 is disengaged from the pipe 37 or engaged with the outer peripheral recess 39 of the pipe 37 (FIG. 3). The pressurized air or gas from the valve chamber 23 of the housing 10 and through the outlet 26 and into the second peripheral space 53 may be used to force the cylinder 50 to move away from the outer peripheral bulge 32 of the casing 30 and to move into the firing chamber 11 of the housing 10.

Figure 3:
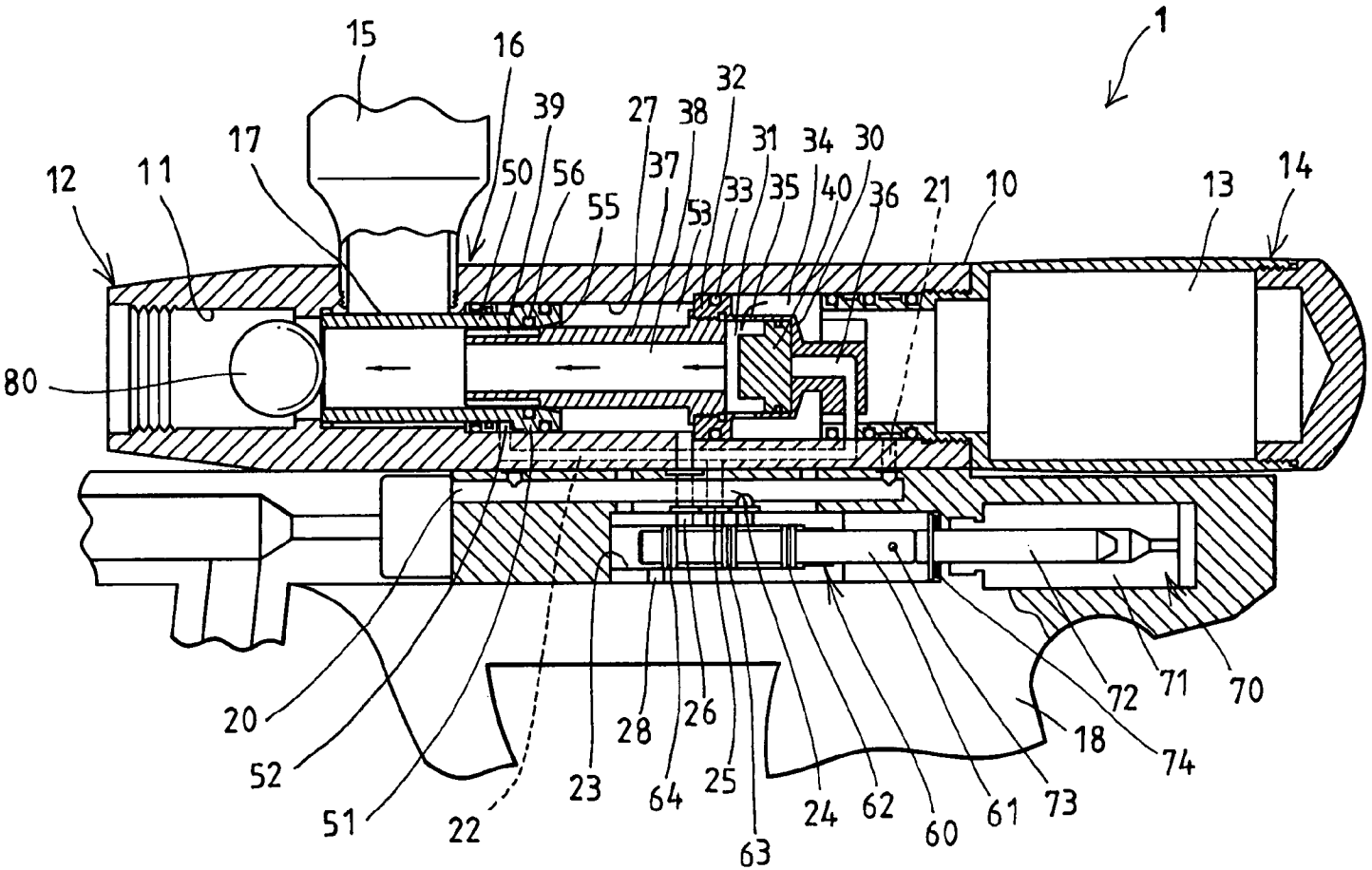
FIG. 3 is an enlarged partial cross sectional view similar to FIG. 2, illustrating the operation of the pneumatic paintball gun or bullet gun device.

As also shown in FIG. 3, when the cylinder 50 is moved into the firing chamber 11 of the housing 10, the cylinder 50 may be used to block the mouth 17 of the feed tube 15 and to move the paintball or bullet 80 that is supplied into the firing chamber 11 of the housing 10 slightly forward to the front portion of the firing chamber 11 of the housing 10 at a firing position and readily for being fired. When mouth 17 of the feed tube 15 is blocked by the cylinder 50, the other paintballs or bullets 80 may be prevented from entering into the firing chamber 11 of the housing 10, and the pressurized air or gas form the pipe 37 may all be guided to fire the paintball or bullet 80 that is supplied into the firing chamber 11 of the housing 10.

The valve device 60 includes a valve stem or valve member 61 slidably received or engaged in the valve chamber 23 of the housing 10 and includes three sealing rings 62, 63, 64 engaged onto the valve member 61 for sealingly engaging with the housing 10 and for selectively communicating the inlet 24 and the port 25 and the valve chamber 23 of the housing 10 with each other (FIG. 2) and thus for allowing the pressurized air or gas from the gas supplying passage 20 and the valve chamber 23 of the housing 10 to flow through the port 25 and into the manifold 22 of the housing 10, and then to flow into the gas flowing path 36 and the control chamber 31 of the casing 30 in order to force the piston 40 to engage with the pipe 37 and to selectively block the bore 38 of the pipe 37, and also to flow into the first peripheral space 52 of the housing 10 in order to move the cylinder 50 toward the casing 30 and to disengage the cylinder 50 from the mouth 17 of the feed tube 15.

The sealing rings 62, 63, 64 of the valve member 61 may also be provided for sealingly engaging with the housing 10 and for selectively communicating the outlet 26 and the port 25 and the valve chamber 23 of the housing 10 with each other (FIG. 3) and thus for allowing the pressurized air or gas to flow backwardly from the manifold 22 into the valve chamber 23 of the housing 10 and then into the second peripheral space 53 of the housing 10 in order to move the cylinder 50 forwardly away from the casing 30 and to engage the cylinder 50 with the mouth 17 of the feed tube 15 or to block the mouth 17 of the feed tube 15 and to move the paintball or bullet 80 that is supplied into the firing chamber 11 of the housing 10 slightly forward to the front portion of the firing chamber 11 of the housing 10 at a firing position and readily for being fired.

A moving or actuating means or device 70 is disposed or secured in the housing 10 and located below the gas storage chamber 13 of the housing 10, and/or located behind the valve chamber 23 of the housing 10, and includes a coil 71 disposed or secured in the housing 10 and an armature or core 72 slidably received or engaged in the coil 71 and coupled to the valve member 61 with such as a coupling pin 73 and moved in concert with the valve member 61, the core 72 and thus the valve member 61 may be moved relative to the housing 10 by the coil 71 when the coil 71 is energized in order to selectively communicate the outlet 26 and the port 25 and the valve chamber 23 of the housing 10 with each other (FIG. 3), for example. A spring biasing means or member 74 may be engaged between the core 72 and the housing 10 for recovering or moving the core 72 and the valve member 61 relative to the housing 10 in order to selectively communicate the inlet 24 and the port 25 and the valve chamber 23 of the housing 10 with each other (FIG. 2) when the coil 71 is not energized.

In operation, as shown in FIG. 2, when the valve member 61 is moved relative to the housing 10 by such as the core 72 of the actuating means or device 70 to selectively communicate the inlet 24 and the port 25 and the valve chamber 23 of the housing 10 with each other and/or to selectively communicate the outlet 26 and the exit 28 of the housing 10 with each other, the pressurized air or gas supplied from the supplying source 88 may flow into the gas supplying passage 20 and then into the valve chamber 23 via the inlet 24 of the housing 10, and then into the manifold 22 via the port 25 of the housing 10, and into the gas flowing path 36 and the control chamber 31 of the casing 30 in order to force the piston 40 to engage with the pipe 37 and to selectively block the bore 38 of the pipe 37.

The pressurized air or gas may also flow into the first peripheral space 52 of the housing 10 in order to move the cylinder 50 toward the casing 30 and to disengage the cylinder 50 from the mouth 17 of the feed tube 15 and thus to allow one of the paintballs or bullets 80 to be supplied from the mouth 17 of the feed tube 15 into the firing chamber 11 of the housing 10 when the cylinder 50 is moved toward the casing 30, the pressurized air or gas received in the second peripheral space 53 of the housing 10 may flow through the outlet 26 and into the valve chamber 23 of the housing 10 and may then flow out through the exit 28 of the housing 10. The pressurized air or gas supplied from the supplying source 88 may also flow into the gas supplying passage 20 and then into the gas storage chamber 13 of the housing 10.

As shown in FIG. 3, when the valve member 61 is moved relative to the housing 10 by such as the spring biasing means or member 74 to selectively communicate the outlet 26 and the port 25 and the valve chamber 23 of the housing 10 with each other, the pressurized air or gas may no longer be supplied from the inlet 24 to the valve chamber 23 and then to the port 25 of the housing 10. At this moment, the pressure in the gas flowing path 36 will be decreased and the pressurized air or gas in the gas flowing path 36 and in the manifold 22 of the housing 10 may flow backwardly into the valve chamber 23 of the housing 10 and then may flow into the second peripheral space 53 to force the cylinder 50 to move away from the casing 30 and to move into the firing chamber 11 of the housing 10 and to move the paintball or bullet 80 slightly forward to the front portion of the firing chamber 11 of the housing 10 at the firing position and readily for being fired.

At this moment or simultaneously, the pressurized air or gas in the gas storage chamber 13 of the housing 10 may all be guided to flow into the control chamber 31 of the casing 30 via the apertures 35 of the casing 30 and then to flow into the bore 38 of the pipe 37 and then into the firing chamber 11 of the housing 10 in order to fire or to propel the paintball or bullet 80 out of the firing chamber 11 of the housing 10. In addition, the pressurized air or gas supplied into the second peripheral space 53 of the housing 10 to force and to move the cylinder 50 may also flow through the inner peripheral opening 55 of the cylinder 50 and into the outer peripheral recess 39 of the pipe 37 and then into the firing chamber 11 of the housing 10 for further provided to fire the paintball or bullet 80 out of the firing chamber 11 of the housing 10.

Accordingly, the pressurized air or gas stored in the gas storage chamber 13 of the housing 10 may all be used to fire the paintball or bullet 80. In addition, the pressurized air or gas supplied into the manifold 22 of the housing 10 to move the cylinder 50 and the piston 40 may also be used to fire the paintball or bullet 80, such that the paintball or bullet 80 may be fired or propelled with a greater quantity of the pressurized air or gas and thus may be fired or propelled for a longer distance. It is to be noted that, for the typical pneumatic paintball guns or bullet guns, the pressurized air or gas stored in the gas storage chamber 13 of the housing 10 may have a portion supplied to move some of the parts or elements of the guns such that the paintball or bullet 80 may only be fired with a shorter distance. In addition, almost of the pressurized air or gas will be released or discharged and may not be reused or recycled to facilitate the bullet firing operation after each firing operation such that a large amount of the pressurized air or gas will be wasted and may not be reused.

Accordingly, the pneumatic paintball gun or bullet gun device in accordance with the present invention includes a structure or mechanism for collecting or reusing the pressurized air or gas that has been used for firing the paintball or bullet and thus for effectively using or employing the pressurized air or gas and for economizing the pressurized air or gas, and for allowing the pressurized air or gas to be completely used for firing the paintball or bullet and thus for allowing the paintball or bullet to be shot for a longer distance.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A gun device comprising:

a housing including an inner chamber formed a middle portion of said housing, and including a firing chamber formed in a front portion of said housing, and including a gas storage chamber formed in a rear portion of said housing, and including a handle for being held by a user, and including a trigger for being actuated by the user, and including a gas supplying passage formed in said housing and communicating with said gas storage chamber of said housing for coupling to a pressurized gas supplying source and for selectively supplying a pressurized gas into said gas storage chamber of said housing, and including a manifold formed in said housing, a feed tube attached to said housing for feeding a bullet into said firing chamber of said housing, and arranged for allowing said bullet to be selectively fired with the pressurized gas supplied into said gas storage chamber of said housing, a casing disposed in said housing and located in front of said gas storage chamber of said housing for forming a peripheral channel between said housing and said casing, and including a control chamber formed in said casing, and including a gas flowing path formed in said casing and communicating said control chamber of said casing with said manifold of said housing, said peripheral channel formed between said housing and said casing being communicating with said gas storage chamber of said housing, and said casing including at least one aperture formed therein and communicating said control chamber of said casing with said peripheral channel of said housing for allowing the pressurized gas to flow into said control chamber of said casing via said at least one aperture of said casing and then to selectively flow into said firing chamber of said housing to fire the bullet, a piston slidably received in said control chamber of said casing and movable relative to said casing for selectively engaging with said casing to block said gas flowing path of said casing, and means for controlling the pressurized gas to selectively flow into said control chamber of said casing and into said firing chamber of said housing and to fire the bullet, and to control the pressurized gas in said gas flowing path of said casing to selectively flow into said firing chamber of said housing and to fire the bullet.

2. The gun device as claimed in claim 1, wherein said housing includes a valve chamber formed therein, an inlet communicating said valve chamber with said gas supplying passage of said housing for allowing the pressurized gas to flow from said gas supplying passage into said valve chamber of said housing, a port communicating said valve chamber with said manifold of said housing for allowing the pressurized gas to flow between said valve chamber with said manifold of said housing, an outlet communicating with said valve chamber of said housing for allowing the pressurized gas to flow between said valve chamber with said firing chamber of said housing, and a valve member slidably received in said valve chamber of said housing for selectively communicating said inlet and said port and said valve chamber of said housing with each other, and also for selectively communicating said outlet and said port and said valve chamber of said housing with each other.

3. The gun device as claimed in claim 2, wherein said valve member includes at least one sealing ring engaged onto said valve member for sealingly engaging with said housing and for selectively communicating said inlet and said port and said valve chamber of said housing with each other, and also for selectively communicating said outlet and said port and said valve chamber of said housing with each other.

4. The gun device as claimed in claim 2 further comprising means for moving said valve member relative to said housing.

5. The gun device as claimed in claim 4, wherein said moving means includes a core coupled to said valve member for moving said valve member relative to said housing.

6. The gun device as claimed in claim 5, wherein said moving means includes a coil disposed in said housing and said core is slidably received in said coil.

7. The gun device as claimed in claim 5, wherein a spring biasing member is engaged between said core and said housing for recovering said core and said valve member relative to said housing when said coil is not energized.

8. The gun device as claimed in claim 2, wherein said casing includes a pipe secured to said casing and located in said inner chamber of said housing, and said pipe includes a bore formed therein and communicating with said control chamber of said casing and said firing chamber of said housing.

9. The gun device as claimed in claim 8, wherein said piston is movable relative to said casing for selectively engaging with said pipe in order to block said bore of said pipe and to prevent the pressurized gas from flowing into said bore of said pipe and said firing chamber of said housing.

10. The gun device as claimed in claim 8, wherein a cylinder is slidably received in said inner chamber of said housing and slidably engaged onto said pipe, and includes a peripheral swelling extended radially and outwardly from said cylinder for sealingly engaging with said housing and said pipe and for separating said inner chamber of said housing into a first peripheral space and a second peripheral space, said first peripheral space is communicating with said manifold of said housing, and said second peripheral space is communicating with said outlet and said valve chamber of said housing.

11. The gun device as claimed in claim 10, wherein said pipe includes an outer peripheral recess formed therein for selectively communicating with said second peripheral space of said housing.

12. The gun device as claimed in claim 11, wherein said cylinder includes an inner peripheral opening formed therein for selectively communicating with said outer peripheral recess of said pipe.

* * * * *